US006032584A

United States Patent [19]

Joutsjoki et al.

[11] Patent Number: 6,032,584

[45] Date of Patent: Mar. 7, 2000

[54] APPARATUS FOR TRANSFERRING PAPER ROLLS ALONG AN INCLINE

[75] Inventors: Jukka Joutsjoki, Järvenpää ; Raimo Ruohio, Koski HL; Esko Nieminen, Hyvinkää, all of Finland

[73] Assignee: Valmet Corporation, Helsinki, Finland

[21] Appl. No.: 08/795,550

[22] Filed: Feb. 6, 1997

[30] Foreign Application Priority Data

| | | | |
|---|---|---|---|
| Feb. 9, 1996 | [FI] | Finland | 960614 |
| Apr. 26, 1996 | [FI] | Finland | 961811 |

[51] Int. Cl.[7] ..... E01B 26/00

[52] U.S. Cl. ..... 104/130.04; 105/164

[58] Field of Search ..... 104/130.04; 105/164; 196/465.1, 867.01, 798, 800

[56] References Cited

U.S. PATENT DOCUMENTS

| | | | |
|---|---|---|---|
| 3,808,979 | 5/1974 | Brown | 104/130.04 |
| 3,884,503 | 5/1975 | Damm | 280/440 |
| 4,030,422 | 6/1977 | Pasquan | 104/130.04 |
| 4,491,074 | 1/1985 | Ackermann et al. | 105/164 |

FOREIGN PATENT DOCUMENTS

| | | | |
|---|---|---|---|
| 126980 | 9/1973 | Denmark . | |
| 1203181 | 10/1965 | Germany | 104/130.04 |
| 3-118269 | 5/1991 | Japan | 105/164 |
| 683167 A5 | 1/1994 | Switzerland . | |
| 1167885 | 10/1969 | United Kingdom . | |
| 1289881 | 9/1972 | United Kingdom . | |

*Primary Examiner*—Christopher P. Ellis
*Assistant Examiner*—Thuy V. Tran
*Attorney, Agent, or Firm*—Cohen, Pontani, Lieberman & Pavane

[57] ABSTRACT

A carriage and track assembly for transferring paper and paperboard rolls along an inclined track. The assembly is useful for the transfer of paper rolls of slippery grades and is based on using a dual track (5, 6) over the length of the inclined section of the transfer track and having compatible wheel sets (3, 4) on the transfer carriage. The front end of the carriage is provided with a wheel assembly (3, 4) in which the rolling perimeter varies at different trackwidths of the assembly. The wheel assembly can be made to run along the inclined sections of said tracks (5, 6) so that in said wheel assembly the rolling perimeters of its wheel sets (3, 4) running on different tracks are vertically located at different heights from the loading platform (1) of the carriage. Thus, the loading platform remains substantially horizontal while the carriage travels along the inclined track.

11 Claims, 2 Drawing Sheets

FIG. 1
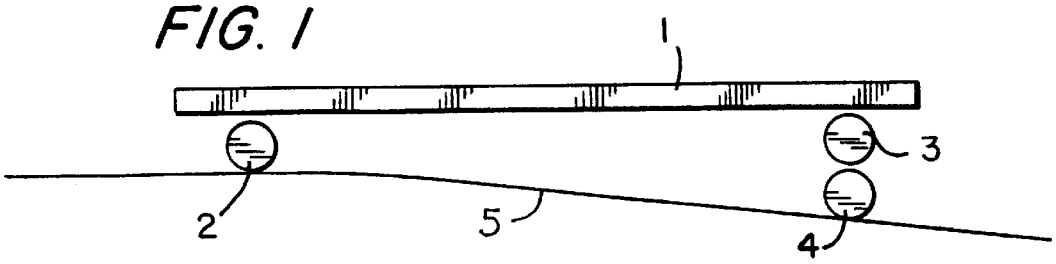
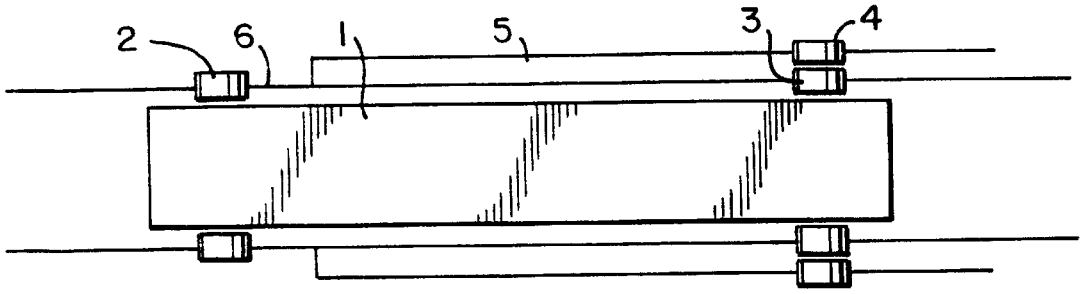
FIG. 2
FIG. 3
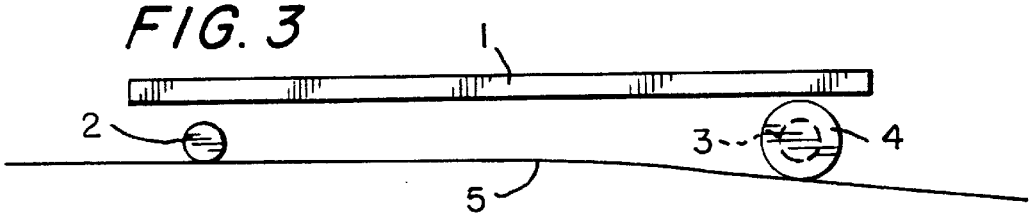
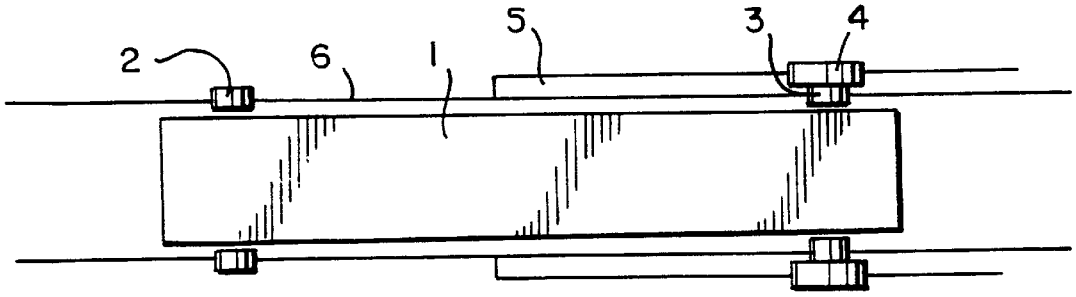
FIG. 4

APPARATUS FOR TRANSFERRING PAPER ROLLS ALONG AN INCLINE

FIELD OF THE INVENTION

The present invention relates to a carriage and track assembly for transferring paper and paperboard rolls along an inclined track.

BACKGROUND OF THE INVENTION

Rolls manufactured in paper mills must often be moved even for long distances by means of various transfer systems. Prior to the wrapping of the rolls in a protective wrapper, they must be handled cautiously to avoid damage to the rolls from impacts on their outer plies or from frictional forces imposed on the roll due to changes in roll speed. A particular problem in the transfer of coated and calendered paper is so-called telescoping of the roll, that is, sliding-out of the inner plies of the roll relative to the outer plies so that the center of the roll protrudes out from the end of the roll. Generally, the acceleration of the roll in its axial direction can be kept sufficiently low during the start and stop of the longitudinal transfer motion of the roll so that telescoping of the roll is avoided. However, the risk of telescoping prevents the longitudinal transfer of rolls of slippery paper grades along inclined tracks, because the plies of the paper roll easily slide with respect to each other even at very small angles of slope of the track. This hampers the use of inclined transfer tracks, and in fact, any transfer of the roll possibly required in the vertical direction from one elevation to another must be implemented using vertical lifts, or alternatively, the plant layout must be designed so that all movements take place in the same vertical elevation. Obviously, this constrains the plant design and thus causes additional costs.

SUMMARY OF THE INVENTION

The present invention provides a transfer arrangement capable of moving rolls, even those of slippery paper grades, along an inclined track.

The goal of the present invention is accomplished by adapting a dual track, at least for the length of the inclined section of the track. The tracks have different track widths. The transfer carriage is provided with compatible sets of wheels so that front-end wheel set of the carriage runs on a track separate from that used by the rear-end wheel set, and at least one end of the carriage has two adjacent sets of wheels with different distances of their rolling perimeter from the loading platform of the carriage.

The present invention offers significant benefits.

By virtue of the assembly according to the invention, it becomes possible to transfer rolls of slippery and hard-surfaced paper grades along an inclined track. Even with overlong rolls called jumbo rolls with a length of 3.5 m to 4 m, the angle of slope of the transfer track can be as steep as 2–3°, and for shorter rolls, the track may be inclined to 5–6°. This facility gives significant latitude in the design of the roll transfer system and plant layout. The loading platform of the transfer carriage can be kept in a desired position without resorting to compensation means requiring the use of active-powered actuators. The transfer system operates without any moving actuator elements or additional control means, and its function is fully self-contained. The present invention can be applied to both upward- and downward-inclined transfer tracks.

Other objects and features of the present invention will become apparent from the following detailed description considered in conjunction with the accompanying drawings. It is to be understood, however, that the drawings are intended solely for purposes of illustration and not as a definition of the limits of the invention, for which reference should be made to the appended claims.

BRIEF DESCRIPTION OF THE DRAWINGS

FIG. 1 is a diagrammatic side view of an embodiment of a carriage according to the present invention;

FIG. 2 is a diagrammatic top view of an embodiment of a carriage according to the present invention shown in FIG. 1;

FIG. 3 is a diagrammatic side view of another embodiment of a carriage according to the present invention;

FIG. 4 is a diagrammatic top view of another embodiment of a carriage according to the present invention shown in FIG. 3.

DETAILED DESCRIPTION OF THE PRESENTLY PREFERRED EMBODIMENTS

Figure 5:
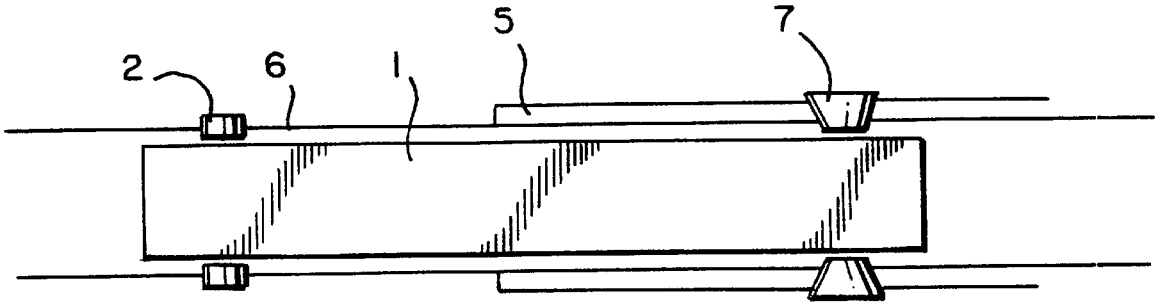

Referring to FIGS. 1 and 2, therein is shown a transfer carriage having two wheel sets 3, 4 at the front end of the carriage and one wheel set 2 at its rear end. The wheel sets 3, 4 are located above each other so that the upper wheel set 3 of narrower trackwidth is situated at the same distance from the loading platform 1 of the carriage as the rear-end wheel set 2 and these wheel sets at the front and rear end of the carriage have the same trackwidth. By contrast, the lower wheel set 4 at the carriage front end is positioned for a wider trackwidth. The level section of the track has only one narrow track 6, and the carriage is arranged to run thereon so that the front-end wheel set 3 of narrower trackwidth and the rear-end wheel set 2 of the same trackwidth roll on said track 6. Additionally, along the length of the inclined section of the transfer track, adjacently parallel to the rails of the narrower main track, are rails of another, wider-spaced track 5 compatible with the trackwidth of the wider-spaced front-end wheel set 4. Now, when the carriage rolls onto the inclined section of the track, the wheel set 4 of wider trackwidth meets the rails of the wider track 5, and the front end of the carriage will be supported running on these wheels. In the beginning of the inclined section of the transfer track, the wider track 5 and the narrower track 6 run in different elevations adjusted to correspond to the height difference between the carriage front-end wheel sets, and said elevation difference is arranged to even out over a track length approximately equal to the wheelbase of the carriage so that, after the transition length of the inclined section of the transfer track, both tracks 5, 6 again run in the same elevation. When the carriage again runs on a level section of the transfer track, the front end of the carriage resumes, in a similar manner, but in reverse order, to run on the front-end wheel set of narrower trackwidth. The height difference between the front-end wheel sets is arranged according to the angle of slope of the transfer track so that the loading platform 1 of the carriage stays horizontal during the travel of the carriage over the inclined section of the transfer track.

Referring to FIGS. 3 and 4, an alternative embodiment is shown therein, now having the carriage front-end wheel sets 3, 4 adapted on the same axle, whereby wheels of different diameters are used for the two sets of wheels. The transitional travel of the carriage over the inclined section of the transfer track and back to a level section occurs in the same manner as described above, and the diameters of the wheel sets are selected so that the loading platform of the carriage stays horizontal at all points along the transfer track.

Besides those embodiments described above, the present invention may have alternative embodiments. For instance, the transfer system may comprise carriages coupled to each other by a chain, whereby the chain is driven by an electric motor. Alternatively, the carriages may be self-powered, or they may be transferred individually by an external actuator. For wrapped rolls, the angles of slope of transfer tracks can be at least doubled by placing the loading platform of the carriage and the loading stations in an anti-inclined position, because the wrapper eliminates the telescoping risk of the roll. In this fashion the angle of slope can be increased to 10–12°, and in fact, the largest possible angle of slope is only limited by the stability of the roll on the loading platform. The adjacently or concentrically mounted wheel sets can be replaced by conical wheels 7, whereby one of the tracks of the inclined section is smoothly widened/narrowed in the beginning and end, respectively, of the inclined section of the transfer track 1 as shown in FIG. 5. By virtue of such an arrangement, the trackwidth of the conical wheel can be made to vary simultaneously also varying the rolling diameter of the wheel so as to keep the loading platform of the carriage in a horizontal position. The tracks may have different trackwidths over the level section of the transfer track, and the wheels can run on a single pair of tracks over the inclined section of the transfer track. The loading platform need not necessarily be perfectly horizontal on any section of the transfer track and its longitudinal inclination may vary. However, the track angle may not be allowed to become so steep on any section of the transfer track that any telescoping risk of the roll might occur.

Thus, while there have been shown and described and pointed out fundamental novel features of the present invention as applied to preferred embodiments thereof, it will be understood that various omissions and substitutions and changes in the form and details of the devices illustrated, and in their operation, may be made by those skilled in the art without departing from the spirit of the present invention. For example, it is expressly intended that all combinations of those elements which perform substantially the same function in substantially the same way to achieve the same results are within the scope of the invention. Substitutions of elements from one described embodiment to another are also fully intended and contemplated. It is also to be understood that the drawings are not necessarily drawn to scale but that they are merely conceptual in nature. It is the intention, therefore, to be limited only as indicated by the scope of the claims appended hereto.

We claim:

1. An apparatus for transferring a paper roll between and along a horizontal surface and an inclined surface, comprising:

a transfer track, at least a portion of said transfer track being comprised of a first track and a second track, said first and second tracks having trackwidths different from one another;

a transfer carriage comprising a first wheel set, a second wheel set and a loading platform, said loading platform being suitable for carrying a paper roll, said first and second wheel sets being mounted to said transfer carriage so as to support the carriage on said transfer track for movement therealong, said first wheel set comprising a first sub-wheel set and a second sub-wheel set, said first sub-wheel set being adapted for travel along said first track and said second sub-wheel set being adapted for travel along said second track, wherein rolling perimeters of said first and second sub-wheel sets are disposed at different heights relative to said loading platform.

2. The apparatus of claim 1, wherein said first and second tracks of said transfer track are at least partially disposed on an inclined surface.

3. The apparatus of claim 2, wherein said first and second tracks of said transfer track run in the same plane over the inclined surface.

4. The apparatus of claim 2, wherein said first and second tracks of said transfer track run at different elevations at a beginning and at an end of the inclined surface.

5. The apparatus of claim 1, wherein said first and second sub-wheel sets each comprise a separate sets of wheels.

6. The apparatus of claim 5, wherein said first sub-wheel set is disposed above said second sub-wheel set relative to said loading platform.

7. The apparatus of claim 5, wherein said first sub-wheel set is disposed axially relative to said second sub-wheel set and said first sub-wheel set has a rolling perimeter different than that of said second sub-wheel set.

8. The apparatus of claim 7, wherein said first and second sub-wheel sets are combined and together comprise a set of conical wheels.

9. The apparatus of claim 8, wherein the trackwidth of at least one of said first and second tracks of said transfer track is varied gradually at a beginning thereof and at an end thereof until the trackwidths of said first and second tracks are substantially equal to one another.

10. The apparatus of claim 9, wherein said first and second tracks of said transfer track are at least partially disposed on an inclined surface.

11. The apparatus of claim 10, wherein said first and second tracks of said transfer track run in the same plane over the inclined surface.

* * * * *